US009486938B2

(12) United States Patent
Pino

(10) Patent No.: US 9,486,938 B2
(45) Date of Patent: Nov. 8, 2016

(54) WASTE WATER COLLECTION DEVICE

(71) Applicant: Angelo J. Pino, New York, NY (US)

(72) Inventor: Angelo J. Pino, New York, NY (US)

( * ) Notice: Subject to any disclaimer, the term of this patent is extended or adjusted under 35 U.S.C. 154(b) by 170 days.

(21) Appl. No.: 14/188,850

(22) Filed: Feb. 25, 2014

(65) Prior Publication Data

US 2014/0273774 A1 Sep. 18, 2014

Related U.S. Application Data

(60) Provisional application No. 61/769,486, filed on Feb. 26, 2013.

(51) Int. Cl.

| | |
|---|---|
| ***B28D 7/02*** | (2006.01) |
| ***B28D 1/04*** | (2006.01) |
| ***B28D 1/02*** | (2006.01) |

(52) U.S. Cl.

CPC ..... *B28D 7/02* (2013.01); *B28D 1/025* (2013.01); *B28D 1/045* (2013.01)

(58) Field of Classification Search

CPC ... B23Q 11/10; B23Q 11/1007; B24B 55/03; B24B 55/12; B24B 57/00; B28D 7/02; B28D 1/025; B28D 1/045

See application file for complete search history.

(56) References Cited

U.S. PATENT DOCUMENTS

| | | | | |
|---|---|---|---|---|
| 5,564,408 | A * | 10/1996 | Bassols | B28D 1/045 125/12 |
| 7,163,010 | B2 * | 1/2007 | Markley | B28D 1/045 125/13.01 |
| 7,699,049 | B2 * | 4/2010 | Burke | B28D 1/045 125/13.01 |
| 9,156,188 | B2 * | 10/2015 | Merck | B28D 7/02 |
| 2014/0013909 | A1 * | 1/2014 | Carlsson | B28D 1/045 83/100 |

* cited by examiner

*Primary Examiner* — Timothy V Eley

(74) *Attorney, Agent, or Firm* — Jeffrey S. Melcher; Manelli Selter PLLC

(57) ABSTRACT

Provided is a waste water collection device for collecting waste water dispelled from a water cooled saw. The device has a trough defining an elongated opening through the top, center and bottom of the trough to allow a water cooled saw blade to pass through the opening and contact a ground surface to be cut. The trough is constructed to retain waste water leaving the water cooled saw during use. A saw connection is constructed for connecting the trough to a water cooled saw so that the saw is within the opening of the trough. A waste water outlet is constructed to remove waste water retained within the trough. A flexible hose is constructed to remove a slurry from a trench cut by the saw during use. A vacuum connector is constructed for connecting a vacuum source to the waste water outlet and flexible hose. Also provided is a method of collecting waste water dispelled from the water cooled saw cutting the ground using the device.

7 Claims, 8 Drawing Sheets

WASTE WATER COLLECTION DEVICE

FIELD OF THE INVENTION

The invention relates to waste water collection device and a method of collecting waste water dispelled from a water cooled saw cutting a trench in a ground surface.

BACKGROUND OF THE INVENTION

Water cooled saws for cutting a trench in a ground surface, especially concrete or asphalt surfaces, are now well known. The saws produce a large amount of waste water that can pollute the surrounding ground water. Furthermore, the waste water can discolor the surface being cut. A slurry in the trench is often created when the water, concrete dust (or other dust) and dirt mix together.

SUMMARY OF THE INVENTION

An objective of the invention is to provide a device and method for collecting waste water dispelled from a water cooled saw cutting a ground surface.

Another objective of the invention is to provide a device and method for collecting a slurry from a trench cut by a water cooled saw cutting a ground surface.

DETAILED DESCRIPTION OF PREFERRED EMBODIMENTS

Figure 1:
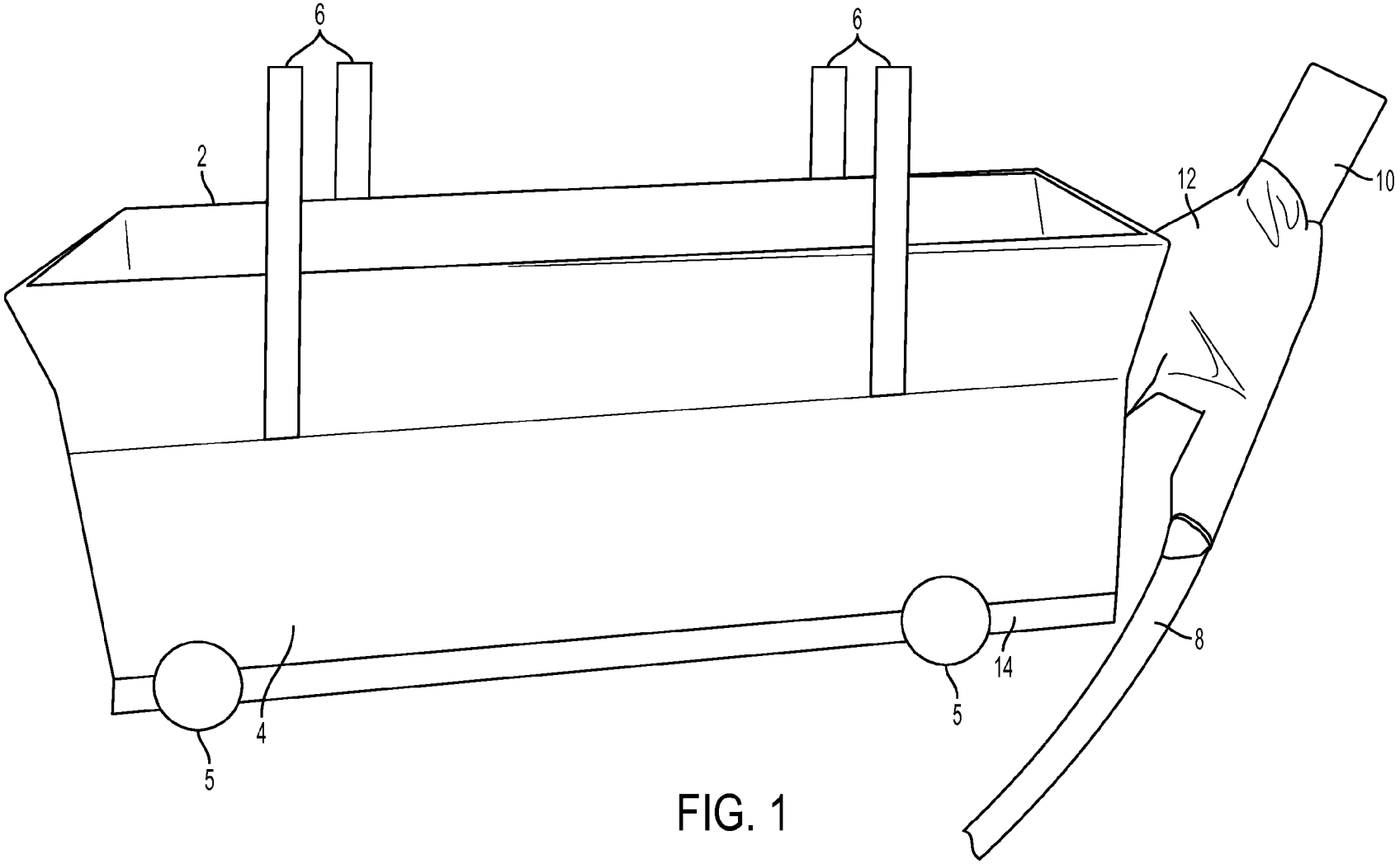
FIG. 1 is a side view of the waste water collection device.
Figure 2:
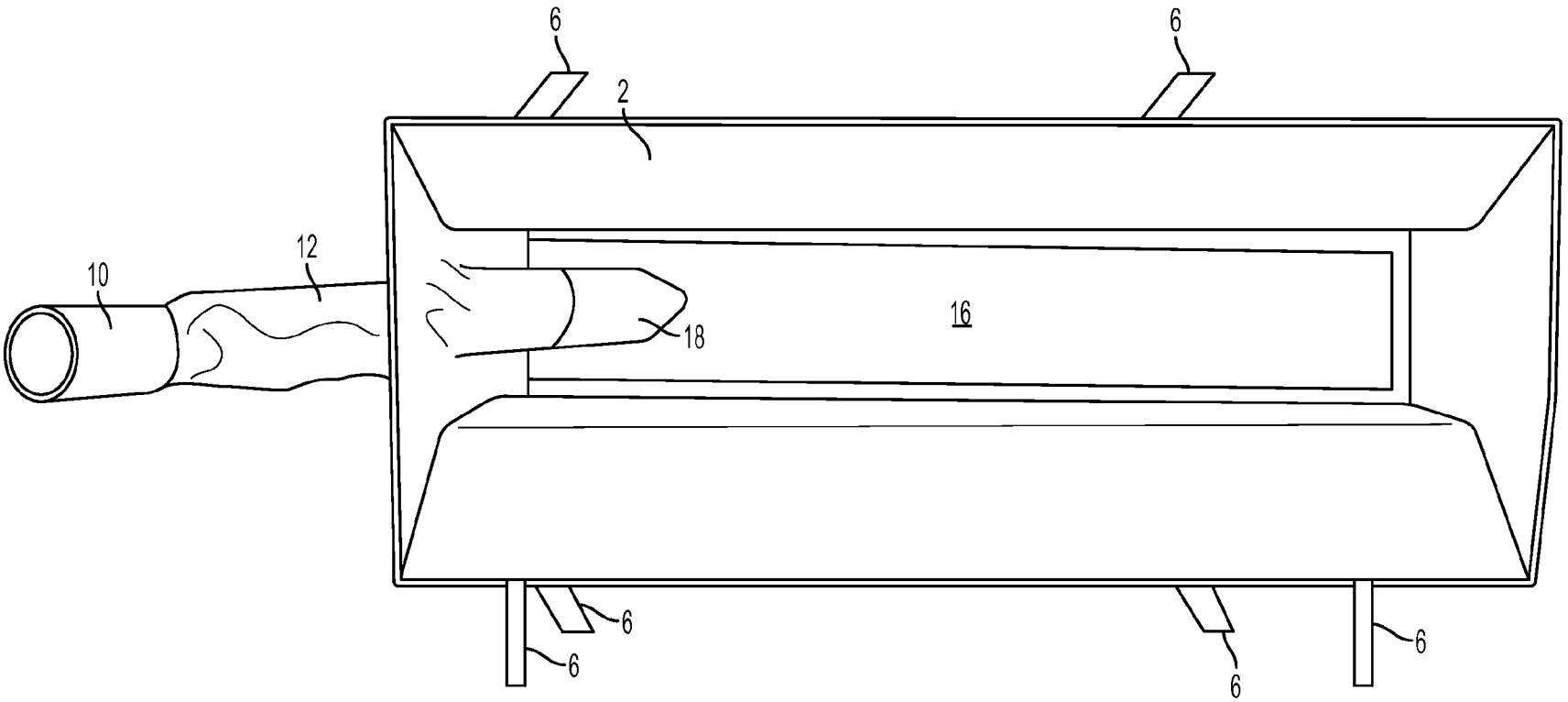
FIG. 2 is a top view of the waste water collection device.
Figure 3:
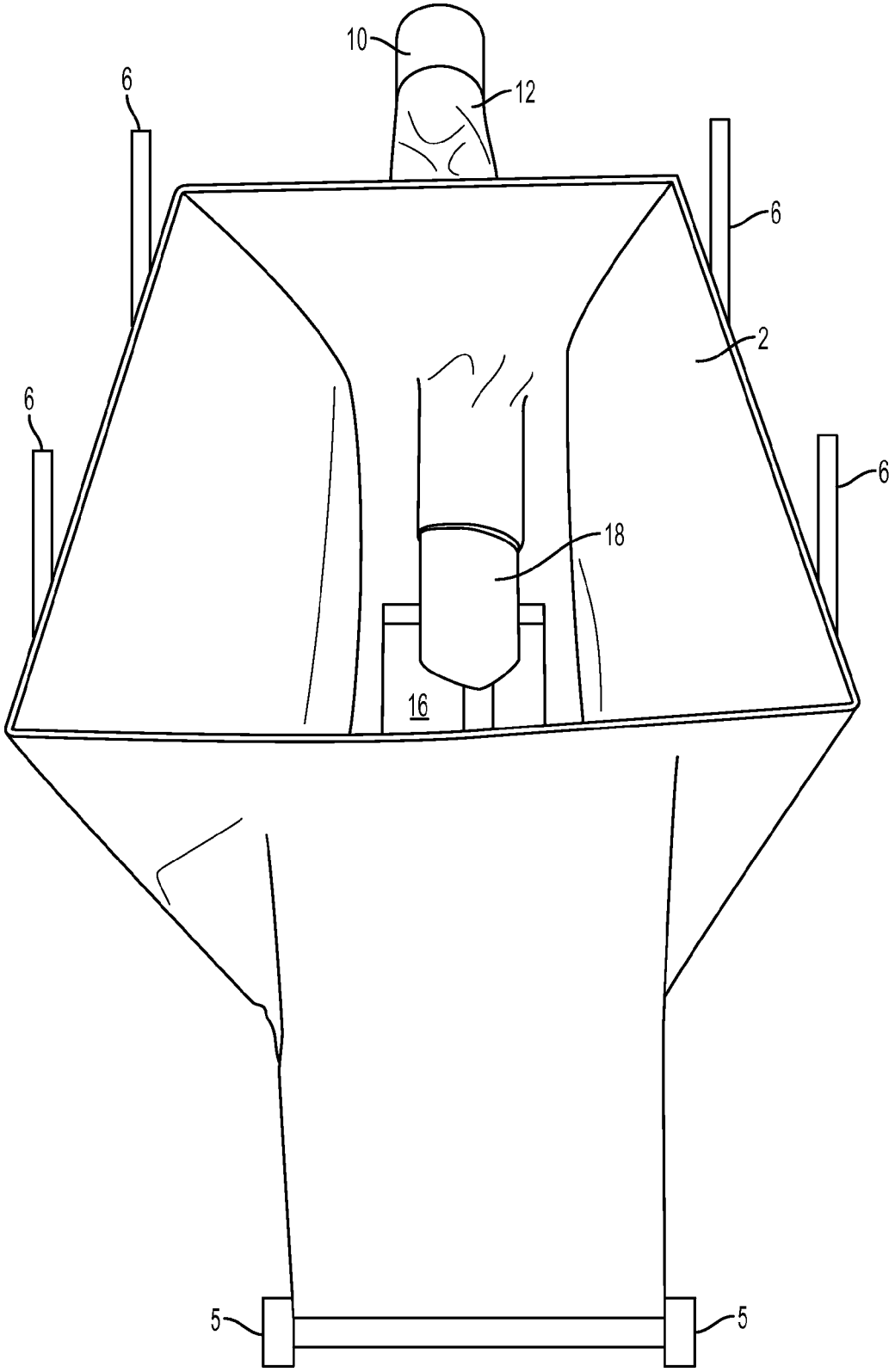
FIG. 3 is a front view of the waste water collection device.

The invention will now be explained with reference to the attached non-limiting FIGS. 1-8.

The water collection device comprises a trough 4 having an elongated opening 16 through the top, center and bottom of the trough 4. The opening 16 exposes the ground surface 7 of the ground to be cut to the blade 9. The opening 16 can be sized for different length, height and width blade 9 sizes and diameters. An example of an opening 16 for a blade 9 is 0.5 inch in width or more, more preferably from 1 inch to 12 inches wide, and from 1 foot to 6 feet long. Blade 9 sizes typically range from 16 inches to 60 inches in diameter and from 0.19 to 1 inch in thickness. Preferably, the trough 4 is sized to accept the largest blade 9 possible for the particular saw 80 the trough 4 is being mounted on so that the trough 4 will work with any blade 9 used on the saw 80. Core Cut/Diamond Products and Husqvarna are commercial examples of water cooled saws 80.

The top of the trough 4 can have a flange 2 for catching waste water dispelled from the saw 80 during use. The front, rear or both ends of the trough 4 can have a pointing device 50 for guiding the saw blade 9 during use.

The trough 4 can be formed from any suitable material, such as metals, fiberglass, plastics, composites, or alloys. The trough 4 is constructed to retain waste water dispelled from the saw during use.

A waste water outlet 18 is constructed and arranged on the inside of the water collection device to remove waste water retained within the trough 4 during use. The outlet 18 can be sized and located in any desired location within the trough 4. However, preferably, outlet 18 is 1 inch or less above ground level, most preferably ¼ inch or less above ground level, so that when a vacuum is applied to the outlet 18 waste water is suctioned into the outlet 18.

The outlet 18 can be connected to a y-connector 12. The y-connector 12 connects the outlet 18 to a vacuum connector 10 constructed to connect to a vacuum source. The y-connector 12 can also be connected to a flexible hose 8. The flexible hose 8 can be raised and lowered to remove slurry in the trench created by the saw during cutting. The flexible hose 8 can be adjusted in size and length depending on the size of the trench.

Figure 5:
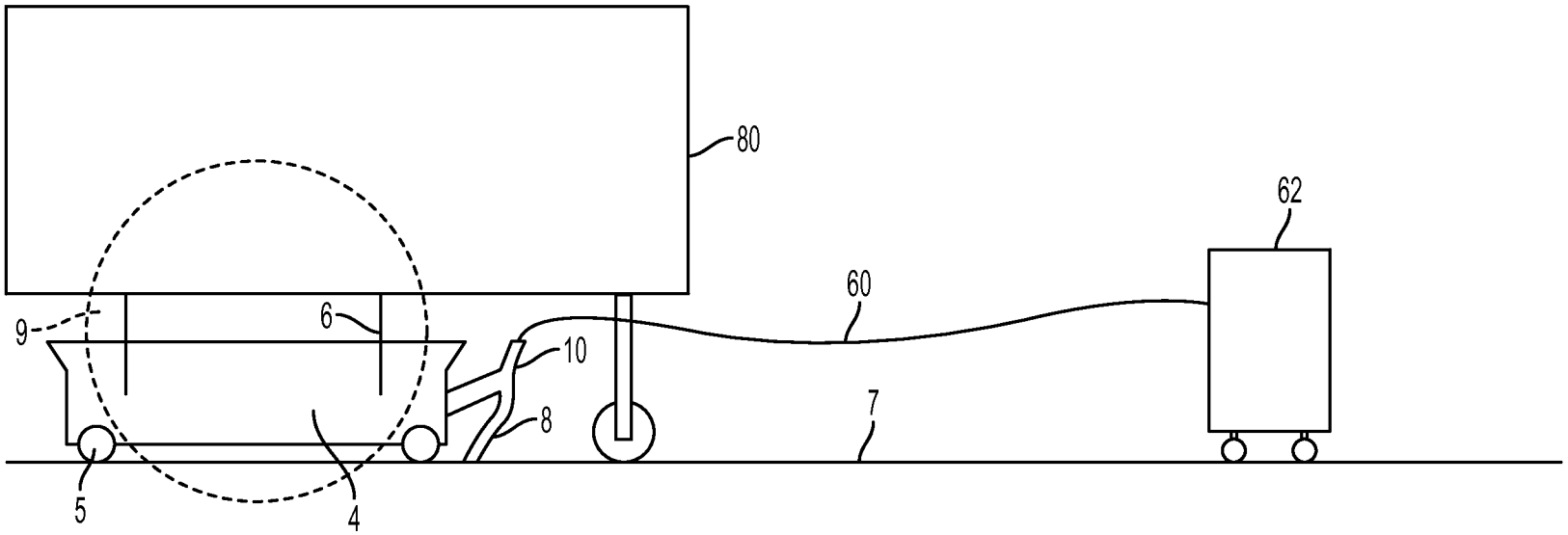
FIG. 5 is an example of the device mounted on a water cooled saw and connected to a drag behind wet vacuum.
Figure 6:
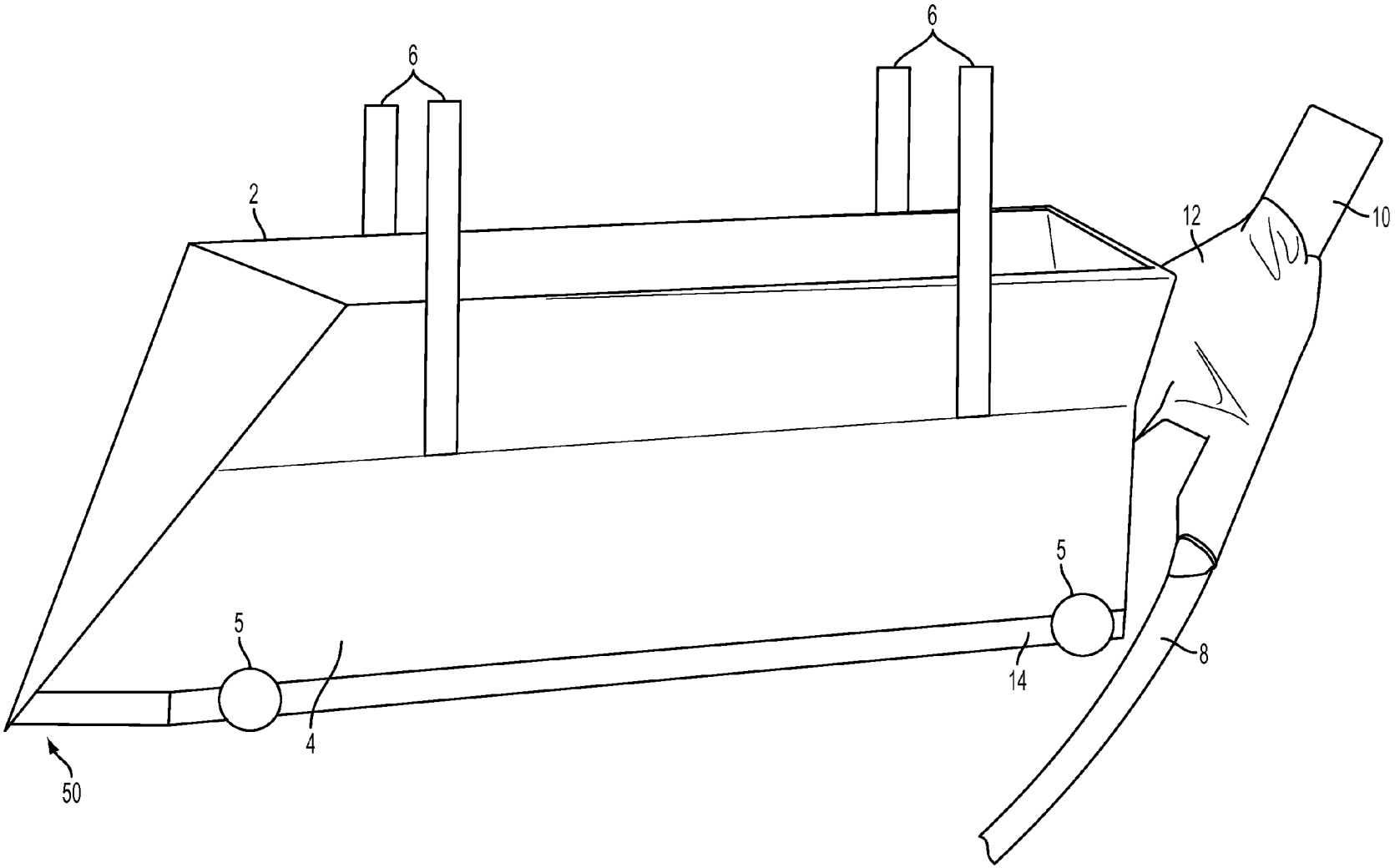
FIG. 6 is a side view of the waste water collection device.
Figure 7:
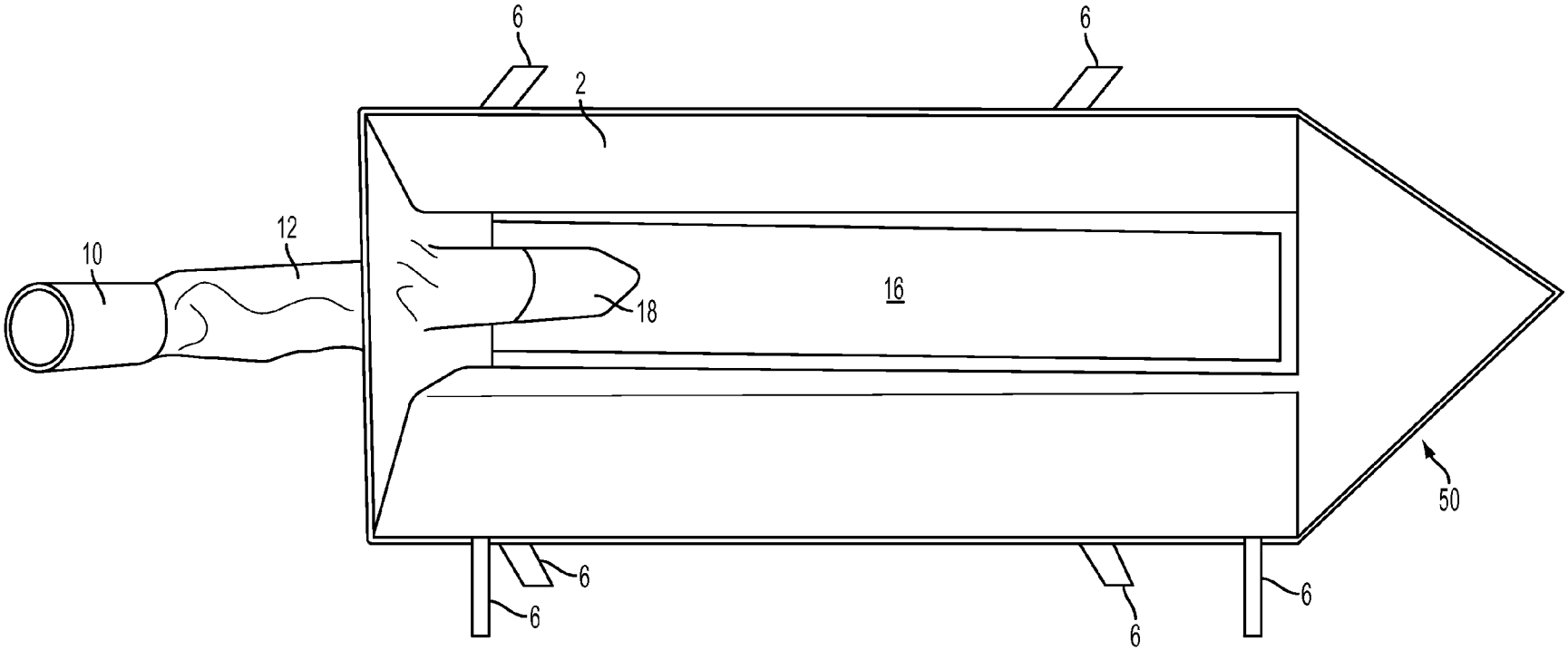
FIG. 7 is a top view of the waste water collection device.
Figure 8:
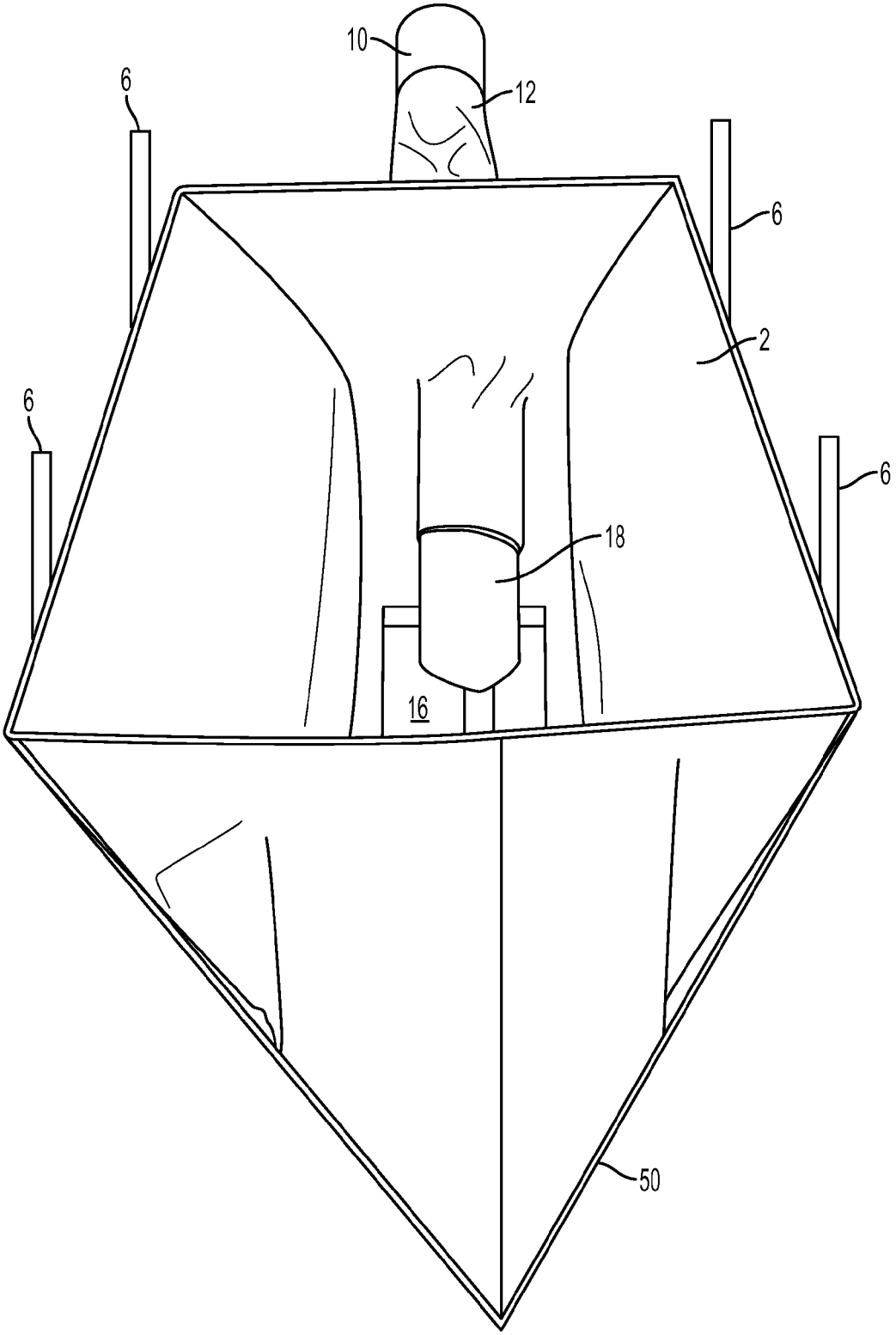
FIG. 8 is a front view of the waste water collection device

Vacuum sources 62 are now well known and any suitable vacuum source 62 can be used, such as a wet vacuum. The vacuum source 62 can dragged behind the saw 80 during use as shown in FIG. 5. The vacuum source 62 can be connected to the vacuum connector 10 by a line 60. Examples of commercially available vacuums and slurry collection systems that can be used include those made by Vermeer, Ditchwitch, Slurry Tec, and The Mud Hen.

The device can include one or saw connections 6 constructed to connect the trough 4 to the saw. Preferably, the connected 6 include a self-leveling system to allow the trough 4 to have constant contact with the ground as the saw is moved during cutting.

Figure 4:
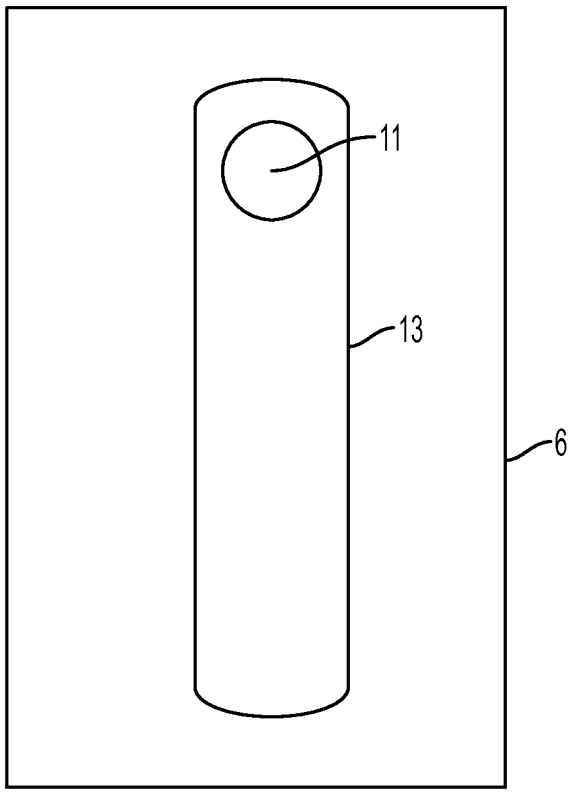
FIG. 4 is an example of a self-leveling bracket.

An example of a self-leveling device is shown in FIG. 4, in which a bolt 11 attached to the saw 80 is located in a slot 13 on the bracket 6 The slot allows the trough 4 to rise and fall along with the surface 7 being cut as shown in FIG. 5.

The bottom of the trough 4 is preferably fitted with a seal 14 for sealing the trough 4 to the ground. The seal 14 can be formed from any suitable material, such as rubber. The seal reduces the amount of waste water escaping the bottom of the trough 4 during use.

The bottom of the trough 4 can have skid plates, wheels or other, shown at 5 in FIG. 5 to reduce wear when dragged over the surface being cut.

A pressure washer can be attached to the device which is constructed to spray water into the trench to force the slurry to loosen and be sucked into the flexible hose 8.

The invention also relates to a method of collecting waste water dispelled from a water cooled saw comprising the steps of:

- providing a trough 4 defining an elongated 16 opening through the top, center and bottom of the trough 4, the opening 16 being sized to allow a water cooled saw blade to pass through opening 16 and contact a ground surface to be cut, the trough 4 being constructed to retain waste water leaving the water cooled saw during use;
- connecting the saw to the trough 4 using a saw connection 6 constructed for connecting the trough 4 to a water cooled saw so that the saw is within the opening 16 of the trough 4;
- providing a waste water outlet 18 constructed to remove waste water retained within the trough 4 during use;
- providing a flexible hose 8 constructed to remove a slurry from a trench cut by the saw during use;
- connecting a vacuum source to a vacuum connector 10 being connected to the waste water outlet 18 and flexible hose 8;
- connecting the saw to a source of water;

cutting a surface of the ground using the saw to form a trench;

supplying water to the saw during cutting;

retaining waste water from the saw in the trough 4 during cutting;

applying a vacuum to the waste water outlet 18 using the vacuum source and removing waste water from the trough through the waste water outlet 18; and applying a vacuum to the flexible hose 8 using the vacuum source and removing a slurry from the trench through the flexible hose 8.

The disclosure herein of the various embodiments is not limited to an individual embodiment but rather said disclosure is intended to apply to any and all embodiments as applicable and appropriate.

I claim:

1. A waste water collection device for collecting waste water dispelled from a water cooled saw comprising:

a trough defining an elongated opening through the top, center and bottom of the trough, the opening being to allow a water cooled saw blade to pass through the opening and contact a ground surface to be cut, the trough being constructed to retain waste water leaving the water cooled saw during use;

a saw connection constructed for connecting the trough to a water cooled saw so that the saw is within the opening of the trough;

a waste water outlet constructed to remove waste water retained within the trough;

a flexible hose constructed to remove a slurry from a trench cut by the saw during use; and a vacuum connector constructed for connecting to a vacuum source, the vacuum connector being connected to the waste water outlet and flexible hose.

2. The waste water collection device according to claim 1, wherein the saw connection is self-leveling.

3. The waste water collection device according to claim 1, further comprising a flexible seal constructed to provide a seal between the trough and a ground surface to be cut by the saw during use.

4. The waste water collection device according to claim 1, further comprising a pointing device constructed for guiding the blade during use.

5. A method of collecting waste water dispelled from a water cooled saw comprising the steps of:

providing a trough defining an elongated opening through the top, center and bottom of the trough, the opening being sized to allow a water cooled saw blade to pass through the opening and contact a ground surface to be cut, the trough being constructed to retain waste water leaving the water cooled saw during use;

connecting the saw to the trough using a saw connection constructed for connecting the trough to a water cooled saw so that the saw is within the opening of the trough;

providing a waste water outlet constructed to remove waste water retained within the trough;

providing a flexible hose constructed to remove a slurry from a trench cut by the saw during use;

connecting a vacuum source to a vacuum connector being connected to the waste water outlet and flexible hose;

connecting the saw to a source of water;

cutting a surface of the ground using the saw to form a trench;

supplying water to the saw during cutting;

retaining waste water from the saw in the trough during cutting;

applying a vacuum to the waste water outlet using the vacuum source and removing waste water from the trough through the waste water outlet; and applying a vacuum to the flexible hose using the vacuum source and removing a slurry from the trench through the flexible hose.

6. The method according to claim 5, further comprising providing a flexible seal to provide a seal between the ground surface and the trough.

7. The method according to claim 5, further comprising providing a self leveling device between the saw and the trough to allow the tough to self level during cutting of the ground surface.

* * * * *